US006237248B1

(12) United States Patent
Mayer

(10) Patent No.: US 6,237,248 B1
(45) Date of Patent: May 29, 2001

(54) CONVECTION DRIER AND METHOD OF USE FOR MANUFACTURING A MATERIAL WEB

(75) Inventor: Roland Mayer, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/393,152

(22) Filed: Sep. 10, 1999

(30) Foreign Application Priority Data

Sep. 11, 1998 (DE) ..... 198 41 767

(51) Int. Cl.[7] ..... F26B 7/00

(52) U.S. Cl. ..... 34/420; 34/425; 34/453; 34/456; 34/464; 34/117; 34/122; 34/123

(58) Field of Search ..... 34/420, 421, 425, 34/452, 453, 456, 458, 461, 464, 114, 116, 117, 122, 123

(56) References Cited

U.S. PATENT DOCUMENTS 4,498,864 2/1985 Roth et al. .
4,972,608 * 11/1990 Ilvespaa ..... 34/115
5,303,484 4/1994 Hagen et al. .
5,588,223 * 12/1996 Marshall ..... 34/414
5,865,955 * 2/1999 Ilvespaa et al. ..... 162/207
6,004,430 12/1999 Ilvesää et al. .

FOREIGN PATENT DOCUMENTS 596882 5/1934 (DE) .
565321 10/1993 (EP) .
97/13031 4/1997 (WO) .

* cited by examiner

*Primary Examiner*—Pamela Wilson
(74) *Attorney, Agent, or Firm*—Greenblum & Bernstein, P.L.C.

(57) ABSTRACT

A dry end of a machine for manufacturing a material web, in particular a paper or cardboard web, includes at least one convection drier, having at least one drying section. The material web passes through the at least one drying section, and is guided between two air-permeable wire belts. The material web can be acted upon by at least one of hot air and hot vapor on one or both sides through the wire belts within the drying section,

51 Claims, 2 Drawing Sheets

CONVECTION DRIER AND METHOD OF USE FOR MANUFACTURING A MATERIAL WEB

CROSS-REFERENCE TO RELATED APPLICATIONS

The present invention claims the priority under 35 U.S.C. §119 of German Patent Application No. 198 41 767.5 filed on Sep. 11, 1998, the disclosure of which is expressly incorporated by reference herein in its entirety.

BACKGROUND OF THE INVENTION

1. Field of the Invention

The invention relates to a dry end of a machine for manufacturing a material web, in particular a paper or cardboard web. It also relates to the convection drier particularly suited for use in such a dry end.

2. Discussion of Background Information

In previously known multi-cylinder dry ends, in order to be dried, the paper web is guided by steam-heated cylinders or of an arrangement of steam-heated cylinders and wire suction rolls. Particularly at the beginning of the drying, however, problems frequently arise in the web guidance which can in particular be traced back to the fact that the still-moist web remains stuck to the smooth contact surfaces of the cylinders or rolls that are absolutely required for a sufficient heat transmission. This frequently leads to web tears and to an overstretching of the web edges. Therefore, as a rule, the assurance must be made that the drying occurs more slowly, which means that the necessary dry end becomes longer as a whole. The above-mentioned problems occur to a more pronounced degree at higher web speeds.

Thus, an object of the present invention is to produce a dry end of the type mentioned above which simultaneously assures a drying rate which is as optimal as possible and thereby an overall length of the dry end which is as short as possible, as well as a reliable web guidance. Furthermore, a convection drier should be produced which is particularly suited for a dry end of this kind.

SUMMARY OF THE INVENTION

With regard to the dry end, this object is attained according to the present invention in that the dry end includes at least one convection drier which has at least one drying section by means of which the material web is guided between two air-permeable wire belts and in which the material web can be acted on with hot air and/or hot vapor on one or both sides through the wire belts.

Based on this embodiment, it is particularly possible to assure a sufficient heat transmission onto the still relatively moist material web at the beginning of the dry end without the necessity of the material web being guided by smooth contact surfaces for his purpose. Instead, in a respective drying section, the material web is guided between two air-permeable wire belts having surfaces oriented toward the material web which are open, i.e., not smooth. Since the smooth contact faces are avoided at the beginning of the drying, the danger of web tears and an overstretching of the web edges is practically eliminated. In particular, higher drying rates are also now possible, such that the overall length of the dry end is considerably shortened.

The drying capacity of the drying process is only limited by a possible influence of the paper quality at an excessive drying speed and no longer by the web guidance of the moist paper web. As long as it is sufficiently moist, the paper is not heated significantly above the cooling limit temperature. Furthermore, with the convection drier that can be more flexibly and rapidly regulated, the paper quality can be influenced more favorably. Thus, a correction of moisture cross direction profiles is also possible at the beginning of the drying phase, particularly with a deliberate heating and drying. Since pressing against heated surfaces is no longer required, the shrinkage prevention at the beginning of the drying is also very slight, which can have a positive effect on the propensity to wrinkle or pucker. The lower heat transmission coefficient in the convection, as compared to a heat transmission by means of smooth contact surfaces, is balanced out, or even overcompensated for, by means of a greater temperature difference and the two-sided drying.

In a preferred practical embodiment of the dry end according to the invention, the convection drier includes at least one drying section that is at least essentially straight, or slightly curved, in terms of the web travel direction, such that a reliable and exact guidance is always assured.

It is advantageous if at least two drying sections are disposed generally one above the other in the convection drier. Such a multi-tier disposition can considerably reduce the structural length such that, particularly in connection with the double-sided drying, an undesirable uneven drying on opposite sides of the web can be prevented.

In one embodiment of the present invention, at least one drying section of the convection drier is formed between two canopy hoods or nozzle hoods. At least one such canopy hood is preferably simultaneously provided with a vapor or air exhaust, which further reduces the required structural length of the dry end. Therefore, an exchange between the heating and evaporation is no longer necessary, which means that the additional evaporation surface is eliminated.

The material web can also be at least partially laterally enclosed by the convection drier at least partially. Since this prevents the exhaust air from mixing with colder ambient air, the exhaust air can be used further at a higher temperature.

If the convection drier has a plurality of drying sections, then the drying sections can also be at least partially controlled separately, particularly in terms of their heating capacity. Thus, a generally more selective and sensitive influence on the material web is possible.

For moisture profiling, the convection drier can suitably have at least one drying section that is divided into zones lateral to the web travel direction. Alternatively or additionally, it is also conceivable to divide the respective canopy hoods at least partially in the web travel direction.

According to a preferred embodiment of the present invention, a closed web guidance is provided throughout the entire convection drier. A closed web guidance of this kind particularly benefits the above-mentioned multi-tier disposition of a plurality of drying sections disposed generally above one another.

A web deflection after a respective drying section is preferably carried out by means of a respective wire suction roll, from which the respective outer wire belt, which is guided through the preceding drying section, is removed so that a shearing of the material web is prevented.

Suitably, the material web is acted on in at least one drying section of the convection drier with hot air and/or hot vapor, having a temperature in a range from approximately 150 to approximately 450° C. and particularly from approximately 200 to approximately 400° C.

According to another aspect of the present invention, the material web is acted on, in at least one drying section of the convection drier, by hot air and/or hot vapor having a flow speed in a range from approximately 60 to approximately 120 m/s, particularly from approximately 90 to 110 m/s, and preferably in the vicinity of 100 m/s.

In a preferred embodiment of the dry end according to the present invention, at least one convection drier is arranged in the web travel direction before a single or double-row cylinder drying group such that, upon reaching the first drying cylinder of this drying group, the material web has preferably already been dried to a dry matter content in the range from approximately 55 to approximately 65%.

The convection drier can thus be provided directly at the beginning or in a beginning region of the dry end, after one or a number of cylinders. Additionally or alternatively, however, it is also possible to provide at least one such convection drier in a main evaporation zone and/or in the end region of the dry end. As a result, an even higher drying rate is achieved, which further shortens the dry end as a whole.

According to another aspect of the invention, a dry end of a machine is provided for manufacturing a material web, in particular a paper or cardboard web. The dry end includes at least one convection drier having at least one drying section through which the material web is guided between two air-permeable wire belts and in which the material web can be acted upon by at least one of hot air and hot vapor on at least one side through the wire belts. The convection drier may have at least one drying section that is at least one of generally straight and slightly curved in terms of the web travel direction. Additionally, the convection drier may include at least two drying sections disposed at least one of generally one above the other and one after the other.

In another aspect of the present invention, the at least one drying section of the convection drier may be formed between two canopy hoods or nozzle hoods. Further, the convection drier may have at least one canopy hood which is simultaneously provided with at least one of a vapor exhaust and an air exhaust.

In a further aspect of the present invention, the dry end is constructed and arranged such that the material web is at least partially enclosed laterally by the convection drier. Moreover, the convection drier may include a plurality of drying sections, and each drying sections can, at least in part, be separately controlled, particularly in terms of their heating capacity. Also, the convection drier may include at least one drying section that is divided into zones lateral to the web travel direction.

According to another aspect of the present invention, the dry end may further include a closed web guidance provided throughout the entire convection drier. Moreover, a web deflection may take place after a respective drying section by means of a respective wire suction roll, and the respective wire suction roll is not engaged by a respective outer wire belt which is guided through a preceding drying section.

In still another aspect of the present invention, in at least one drying section of the convection drier of the dry end, the material web may be acted upon by at least one of hot air and hot vapor having a temperature in a range from approximately 150° C. to approximately 450° C., and the temperature range may be from approximately 200° C. to approximately 400° C.

In a further aspect of the invention, in the drying section of the convection drier, the material web may be acted upon by at least one of hot air and hot vapor having a flow speed in a range from approximately 60 to approximately 120 m/s. Preferably the flow speed is in a range from approximately 90 to 110 m/s, and more preferably the flow speed is about 100 m/s.

In another aspect of the present invention, the dry end includes at least one convection drier disposed in a web travel direction before at least one of a single double-row cylinder drying group, such that upon reaching a first drying cylinder of the drying group, the material web has preferably already been dried to have a dry matter content in the range from approximately 55% to approximately 65%. Also, at least one convection drier may be disposed after at least one of a cylinder and a material web guide roll.

According to another aspect of the invention, a convection drier for treating a material web, in particular a paper or cardboard web, and particularly for use in a dry end, is provided. The convection drier includes at least one drying section through which the material web is guided between two air-permeable wire belts, and in which the material web can be acted upon by at least one of hot air and hot vapor on both sides of the material web through the wire belts. The convection drier may further include at least one drying section that is at least one of generally straight and slightly curved in terms of a web travel direction, and at least two drying sections that are disposed generally one above the other.

In a further aspect of the present invention, the convection drier may be configured with at least one drying section formed between two canopy hoods or nozzle hoods, and the convection drier having at least one drying section may also include at least one canopy hood which is simultaneously provided with at least one of a vapor exhaust and an air exhaust. Additionally, the at least one canopy hood may at least partially laterally enclose the material web.

In another aspect of the present invention, the convection drier may include a plurality of drying sections that can at least in part be separately controlled. The convection drier may be configured such that the plurality of drying sections can at least in part be separately controlled in terms of their heating capacity.

According to other aspects of the present invention, the convection drier may include at least one drying section that is divided into zones lateral to the web travel direction. The convection drier may also include a continuously closed web guidance. In this regard, a respective web deflection can take place after a respective drying section by means of a respective wire suction roll, and the respective wire suction roll is not engaged by a respective outer wire belt, which is guided through a preceding drying section.

According to a further aspect of the present invention, a method of treating a material web is provided, which includes passing the web between at least a first and a second air permeable belt, passing the at least first and second air permeable belts between at least a first and a second canopy hood, and providing a treatment medium to at least one of the canopy hoods such that the treatment medium passes through at least one of the first and second air permeable belts, such that the material web is subject to the treatment medium. The method may also include dividing at least one of the canopy hoods into a plurality of zones extending laterally to a web travel direction, and providing a plurality of the canopy hoods disposed generally one above the other.

In another aspect of the present invention, the method of treating a material web may further include continuously guiding the material web through each of the plurality of canopy hoods. In this regard, the continuous guiding may include deflecting the material web by a suction roll, and the respective suction roll is not engaged by a respective air permeable belt which is guided through a preceding pair of canopy hoods.

In still another aspect of the present invention, the treatment medium of the method of treating a material web may include at least one of a vapor and air, and heating the at least one of vapor and air. Additionally, the at least one of vapor and air may be heated to a temperature of about 150° C. to about 450° C., and preferably the at least one of vapor and air is heated to a temperature of about 200° C. to about 400° C.

In another aspect of the present invention, the method of treating a material web may further include providing the treatment medium with a flow speed in the range of about 60 m/s to about 120 m/s, preferably the medium flow speed is in the range of about 60 m/s to about 120 m/s, more preferably the treatment medium flow speed is in the range of about 90 m/s to about 110 m/s, and most preferably the treatment medium flow speed is about 100 m/s.

BRIEF DESCRIPTION OF THE DRAWINGS

The present invention is further described in the detailed description which follows, in reference to the noted drawing by way of non-limiting examples of preferred embodiments of the present invention, wherein same reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

A convection drier 10 of the present invention is particularly suited for use in the dry end of a machine for producing a material web 12, such as a paper or cardboard web, in which in particular, a single or double-row cylinder drying group can then be provided after a convection drier of this kind.

Figure 1:
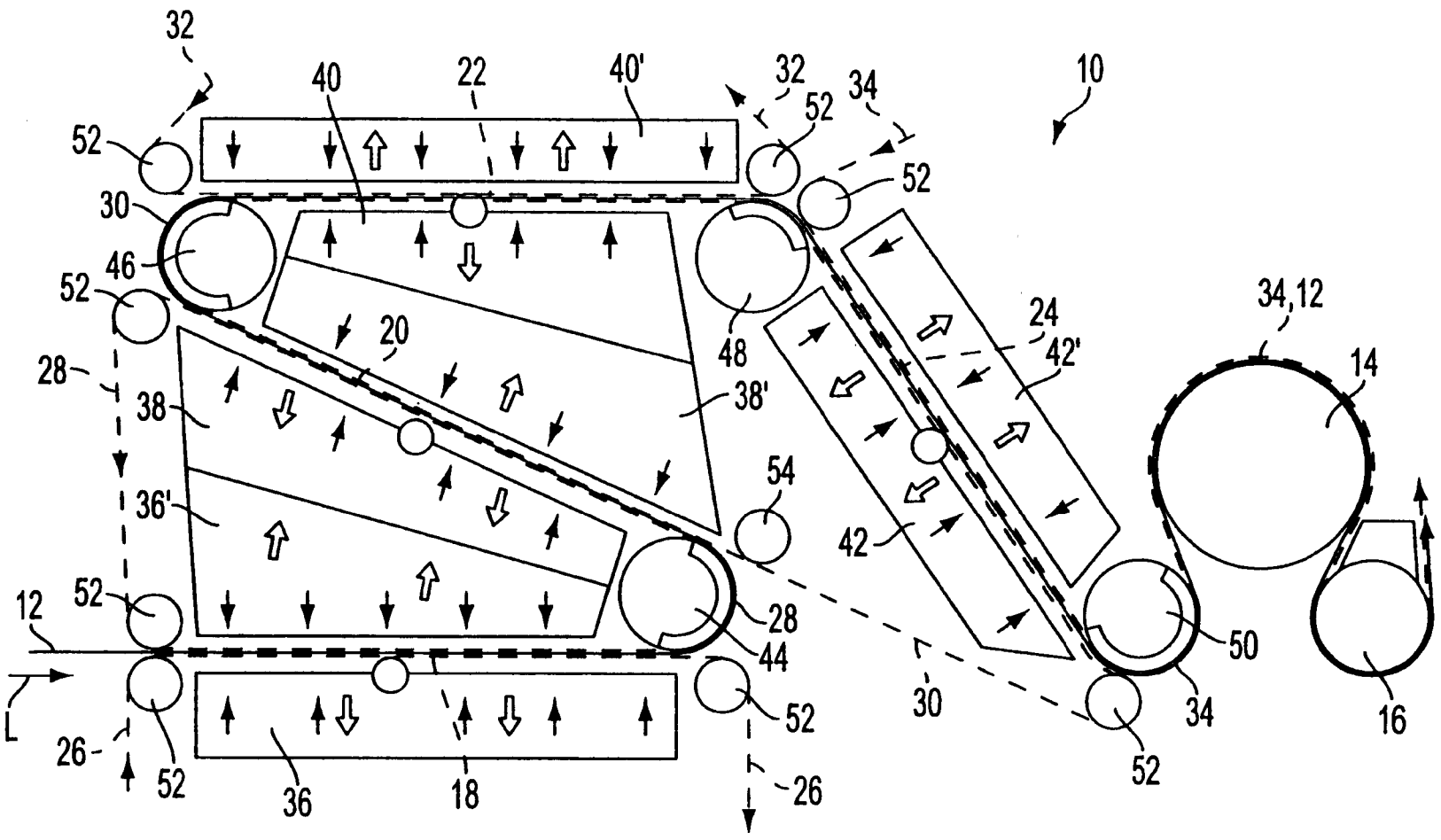
FIG. 1 is a schematic representation of a first embodiment of a convection drier for treating a material web.

FIG. 1 shows the first drying cylinder 14 and a first wire suction roll 16 of a single-row cylinder drying group, for example, following the convection drier 10. In the current exemplary embodiment, the material web 12 is supplied to the convection drier 10, for example, with a dry matter content of approximately 45 to 55%, and is transferred to the cylinder drying group with a dry matter content of approximately 60 to approximately 65%. In principle, however, the material web 12 can also have other dry matter contents at the beginning and/or the end of the convection drier 10.

As can be inferred from FIG. 1, the convection drier 10 includes three drying sections 18, 20, 22, which are disposed one above the other and are straight or slightly curved, as well as another straight or slightly curved drying section 24 disposed next to this first group of drying sections. The inclined drying section 20, which is disposed between the two horizontal drying sections 18 and 22, extends from bottom to top, i.e., the material web 12 is conveyed upward from the bottom by means of the middle drying section 20. In contrast, the web guidance in the last drying section 24, which is likewise inclined, extends from top to bottom.

However, the convection drier according to the invention can also be composed of the above-described straight or slightly curved drying sections in a different configuration. The material web 12 is guided respectively between two air-permeable wire belts 26, 28; 28, 30; 30, 32; or 32, 34 through the straight drying sections 18 to 24 of the convection drier 10, such that it is acted upon by hot air and/or hot vapor on both sides through the respective wire belts in each drying section 18 to 24.

To that end, the drying sections 18 to 24 respectively include two canopy hoods or nozzle hoods 36, 36'; 38, 38'; 40, 40', or 42, 42'. As indicated in FIG. 1 by corresponding arrows, each of these canopy hoods 36 to 42 and 36' to 42' is simultaneously provided with a vapor or air exhaust by a supply (not shown). Each of these canopy hoods can also be provided with exhaust openings (not shown), for example, by means of which vapor or moist air can also be aspirated directly in the appropriate area.

The individual canopy hoods can, individually or in groups, be provided with different temperatures and/or different pressures, i.e., blowing speeds, in the travel direction. Thus, it is possible to create a desired heat curve in the travel direction and also to influence the drying speed on the upper and lower sides in a concerted manner. It is also possible to couple the heated canopy hoods with one another in a cascading manner.

The canopy hoods 36 to 42 and 36' to 42' can also laterally encompass the material web 12. Since this consequently prevents the exhaust air from mixing with colder ambient air, this exhaust air can be used further at relatively high temperature. In this regard, the lateral opening between the canopy hoods on the upper and lower sides can be covered by a wall or covering so that the material web and the air permeable wire belts are guided through a sort of tunnel formed by the canopy hoods and the lateral coverings. For this purpose, the canopy hoods must be wider than the air permeable wire belts. The coverings can be connected to one of the canopy hoods, Additionally, the canopy hoods can be pivoted away in the case of a tear in the material web or for service.

The covering prevents heated air from escaping and prevents cool air from entering at the edge of the material web. The heated air blast openings of the boxes are only located in the region of the material web. Of course, the canopy hoods could also be embodied without this lateral covering and, e.g., may be smaller than the air permeable wire belts.

The drying sections 18 to 24 can be at least in part separately controlled, particularly in terms of their heating capacity. In addition, for moisture profiling, they can be divided into zones extending laterally to the web travel direction L. At least one canopy hood may have zones extending laterally to the travel direction (the width of the zones being about 100–500 mm, preferably about 100–300 mm), whose pressure zones are separated from one another by walls In other words, the pressure with which the heated air is pushed out can be regulated in individual zones such that a moisture profiling is possible by means of different drying speeds across the width. In order to prevent drawing of the canopy hoods, the same temperature is blown across the width and only air speed is regulated in the individual zones.

The web deflection after the drying sections 18 to 24 occurs respectively by means of wire suction rolls 44, 46, 48, 50, from which the outer wire belt 26, 28, 32, or 30, which is guided through the preceding drying section 18 to 24, is removed, The wire belts 26 to 34 are additionally guided by means of the deflection rolls 52 in the manner that can be seen in FIG. 1. While the wire belts 26, 32, and 34 are each only associated with one drying section 18, 22, or 24, the two wire belts 28 and 30 are each guided trough two drying sections 18 and 20 or 20 and 24. As can be seen in FIG. 1, the wire belt 30 is additionally guided by way of a support roll 54 before entry into the drying section 20. After the last drying section 24, the wire belt 34 is given by way of the suction wire roll 40 to the first drying cylinder 14 of a single-row drying group.

As can be inferred in particular from FIG. 1, a closed web guidance is consequently produced throughout the entire convection drier 10.

Figure 2:
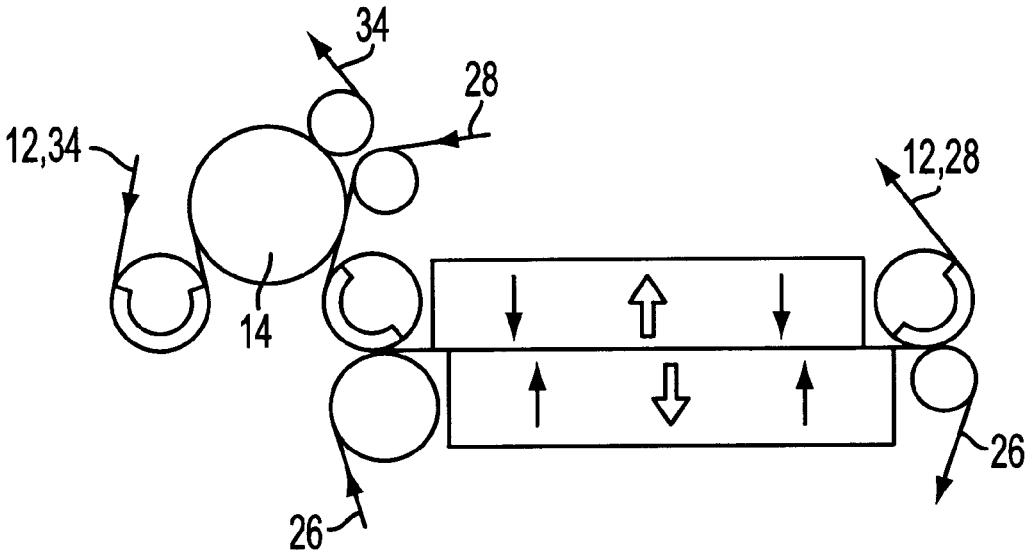
FIG. 2 is a schematic representation of another embodiment of a convection drier.

According to another embodiment of the present invention depicted in FIG. 2, the convection drier can also be provided directly at the beginning or in the beginning region of the dry end, after one or a number of cylinders 14. The wire belts 34, 26, and 28 and the material web 12 can be guided, for example, in the manner shown in FIG. 2.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A dry end of a machine for manufacturing a material web, comprising:

at least one convection drier having at least two drying sections, disposed generally above one another, through which the material web is guided between two air-permeable wire belts and in which the material web can be acted upon by at least one of hot air and hot vapor on at least one side of the web through the wire belts.

2. The dry end according to claim 1, wherein said convection drier has at least one drying section that is at least one of generally straight and slightly curved in terms of the web travel direction.

3. The dry end according to claim 1, wherein said convection drier further includes at least one additional drying section disposed next to said at least two drying sections disposed above one another.

4. The dry end according to claim 1, wherein said at least one drying section of the convection drier is formed between one of two canopy hoods and nozzle hoods.

5. The dry end according to claim 1, wherein said convection drier has at least one canopy hood which is simultaneously provided with at least one of a vapor exhaust and an air exhaust.

6. The dry end according to claim 1, wherein the material web is at least partially enclosed laterally by the convection drier.

7. The dry end according to claim 1, wherein said convection drier comprises a plurality of drying sections, and said drying sections can at least in part be separately controlled, particularly in terms of their heating capacity.

8. The dry end according to claim 1, wherein said convection drier includes at least one drying section that is divided into zones lateral to the web travel direction.

9. The dry end according to claim 1, further comprising a closed web guidance provided throughout the entire convection drier.

10. The dry end according to claim 1, wherein a web deflection takes place after a respective drying section by means of a respective wire suction roll, and the respective wire suction roll is not engaged by a respective outer wire belt which is guided through a preceding drying section.

11. The dry end according to claim 1, wherein in at least one drying section of the convection drier, the material web is acted upon by at least one of hot air and hot vapor having a temperature in a range from approximately 150° C. to approximately 450° C.

12. The dry end according to claim 1, wherein said temperature range is from approximately 200° C. to approximately 400° C.

13. The dry end according to claim 1, wherein in at least one drying section of the convection drier, the material web is acted upon by at least one of hot air and hot vapor having a flow speed in a range from approximately 60 to approximately 120 m/s.

14. The dry end according to claim 13, wherein said flow speed is approximately 90 to 110 m/s.

15. The dry end according to claim 14, wherein said flow speed is about 100 m/s.

16. The dry end according to claim 1, wherein at least one convection drier is disposed in a web travel direction before at least one of a single double-row cylinder drying group, wherein upon reaching a first drying cylinder of the drying group, the material web has preferably already been dried to have a dry matter content in the range from approximately 55% to approximately 65%.

17. The dry end according to claim 16, wherein at least one convection drier is disposed after at least one of a cylinder and a material web guide roll.

18. The dry end according to claim 1, wherein the web travels in a direction which enters into a first drying section in a substantially horizontal orientation, the web then reverses direction above said first drying section and enters a second drying section disposed above said first drying section at an angled inclination, and then the web reverses direction and travels above said first and second drying sections and enters a third drying section in a substantially horizontal orientation.

19. The dry end according to claim 1, wherein said at least two drying sections are disposed above one another in a vertical orientation with respect to web travel direction, such that the material web travels upwardly in a zig-zag direction through said at least two drying sections.

20. The dry end according to claim 1, wherein the material web comprises one of paper and cardboard.

21. A convection drier for treating a material web, particularly for use in a dry end, comprising:

at least two drying sections, disposed generally above one another, through which the material web is guided between two air-permeable wire belts, and in which the material web can be acted upon by at least one of hot air and hot vapor on both sides of the material web through the wire belts.

22. The convection drier according to claim 21, further comprising at least one drying section that is at least one of generally straight and slightly curved in terms of a web travel direction.

23. The convection drier according to claim 21, further comprising at least two drying sections that are disposed generally one above the other.

24. The convection drier according to claim 21, wherein said at least one drying section is formed between two canopy hoods or nozzle hoods.

25. The convection drier according to claim 21, wherein said at least one drying section includes at least one canopy hood which is simultaneously provided with at least one of a vapor exhaust and an air exhaust.

26. The convection drier according to claim 25, wherein said at least one canopy hood at least partially laterally encloses the material web.

27. The convection drier according to claim 21, comprising a plurality of drying sections that can at least in part be separately controlled.

28. The convection drier according to claim 27, wherein said plurality of drying sections that can at least in part be separately controlled in terms of their heating capacity.

29. The convection drier according to claim 21, wherein at least one drying section is divided into zones lateral to the web travel direction.

30. The convection drier according to claim 21, wherein a continuously closed web guidance is provided.

31. The convection drier according to claim 21, wherein a respective web deflection takes place after a respective drying section by means of a respective wire suction roll, and the respective wire suction roll is not engaged by a respective outer wire belt, which is guided through a preceding drying section.

32. The dry end according to claim 21, wherein the web travels in a direction which enters into a first drying section in a substantially horizontal orientation, the web then reverses direction above said first drying section and enters a second drying section disposed above said first drying section at an angled inclination, and then the web reverses direction and travels above said first and second drying sections and enters a third drying section in a substantially horizontal orientation.

33. The dry end according to claim 21, wherein said at least two drying sections are disposed above one another in a vertical orientation with respect to web travel direction, such that the material web travels upwardly in a zig-zag direction through said at least two drying sections.

34. The convection drier according to claim 21, wherein the material web comprises one of paper and cardboard.

35. A method of treating a material web, comprising:

passing the web between at least a first and a second air permeable belt;

passing said at least first and second air permeable belts between at least two drying sections disposed generally above one another, wherein each drying section comprises at least a first and a second canopy hood; and providing a treatment medium to at least one of said canopy hoods such that said treatment medium passes through at least one of said first and second air permeable belts, such that the material web is subject to the treatment medium.

36. The method of treating a material web according to claim 35, further comprising dividing at least one of said canopy hoods into a plurality of zones extending laterally to a web travel direction.

37. The method of treating a material web according to claim 35, further comprising providing a plurality of said canopy hoods disposed generally one above the other.

38. The method of treating a material web according to claim 37, further comprising continuously guiding the material web through each of said plurality of canopy hoods.

39. The method of treating a material web according to claim 38, wherein said continuous guiding includes deflecting the material web by a suction roll, and the respective suction roll is not engaged by a respective air permeable belt which is guided through a preceding pair of canopy hoods.

40. The method of treating a material web according to claim 35, wherein said treatment medium comprises at least one of a vapor and air.

41. The method of treating a material web according to claim 40, further comprising heating the at least one of vapor and air.

42. The method of treating a material web according to claim 41, wherein said at least one of vapor and air is heated to a temperature of about 150° C. to about 450° C.

43. The method of treating a material web according to claim 41, wherein said at least one of vapor and air is heated to a temperature of about 200° C. to about 400° C.

44. The method of treating a material web according to claim 35, further comprising providing said treatment medium with a flow speed in the range of about 60 m/s to about 120 m/s.

45. The method of treating a material web according to claim 44, wherein said treatment medium flow speed is in the range of about 60 m/s to about 120 m/s.

46. The method of treating a material web according to claim 45, wherein said treatment medium flow speed is in the range of about 90 m/s to about 110 m/s.

47. The method of treating a material web according to claim 46, wherein said treatment medium flow speed is about 100 m/s.

48. A dry end of a machine for manufacturing a material web, in particular a paper or cardboard web, comprising:

at least one convection drier further comprising, a first horizontally oriented drying section, a second angularly inclined drying section disposed above said first drying section, and a third horizontally oriented drying section disposed above said first and second drying sections;

wherein the material web travels through said at least one convection drier between two air-permeable wire belts such that the material web is guided through said first, second, and third drying sections in a zig-zag travel direction;

wherein the material web can be acted upon by at least one of hot air and hot vapor on at least one side through the wire belts.

49. A dry end of a machine according to claim 48, further comprising a fourth angularly declined drying section.

50. A dry end of a machine for manufacturing a material web, in particular a paper or cardboard web, comprising:

at least one convection drier having at least two drying sections, wherein one of the drying sections is disposed generally above another at an inclined orientation, through which the material web is guided between two air-permeable wire belts and in which the material web can be acted upon by at least one of hot air and hot vapor on at least one side of the web through the wire belts.

51. A dry end of a machine for manufacturing a material web, in particular a paper or cardboard web, comprising:

at least one convection drier having at least two drying sections wherein each drying section comprises a canopy or nozzle hood disposed above and below the web and at least a first and second air permeable belt, said at least two drying sections being disposed generally above one another, through which the material web is guided between two air-permeable wire belts and in which the material web can be acted upon by at least one of hot air and hot vapor on at least one side of the web through the wire belts.

* * * * *